US007883339B2

(12) United States Patent
Hsu et al.

(10) Patent No.: US 7,883,339 B2
(45) Date of Patent: Feb. 8, 2011

(54) SOCKET CONNECTOR CONFIGURED WITH WAFERS HAVING PLURALITY OF CONTACTS ASSEMBLED THEREIN

(75) Inventors: Hsiu-Yuan Hsu, Tu-Cheng (TW); Ke-Hao Chen, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/625,568

(22) Filed: Nov. 25, 2009

(65) Prior Publication Data

US 2010/0130067 A1 May 27, 2010

(30) Foreign Application Priority Data

Nov. 25, 2008 (FR) ..... 097221049

(51) Int. Cl.
*H01R 12/00* (2006.01)

(52) U.S. Cl. ..... 439/66; 439/330

(58) Field of Classification Search ..... 439/66, 439/70–73, 330, 331; 324/754, 755
See application file for complete search history.

(56) References Cited

U.S. PATENT DOCUMENTS 5,727,954 A * 3/1998 Kato et al. ..... 439/66
6,036,503 A * 3/2000 Tsuchida ..... 439/70
6,046,597 A 4/2000 Barabi
6,709,279 B2 * 3/2004 Uratsuji ..... 439/71
7,102,373 B2 * 9/2006 Yoshida ..... 324/755
7,471,096 B2 * 12/2008 Kohashi et al. ..... 324/755

FOREIGN PATENT DOCUMENTS

TW M340609 9/2008

* cited by examiner

*Primary Examiner*—Thanh-Tam T Le
(74) *Attorney, Agent, or Firm*—Andrew C. Cheng; Wei Te Chung; Ming Chieh Chang

(57) ABSTRACT

A socket connector includes a frame having a receiving cavity therein, a plurality of wafers aligned along a direction and received in the receiving cavity of the frame, and a plurality of contacts. The wafer is formed with a plurality of parallel slots located along at least one surface thereof and matched with corresponding slots of a neighboring wafer to constitute a plurality of receiving holes. The contacts are received in the receiving holes respectively. Each contact includes a top contacting section extending upwardly beyond an upper surface of the wafers and a bottom contacting section extending downwardly beyond a lower surface of the wafers.

17 Claims, 6 Drawing Sheets

SOCKET CONNECTOR CONFIGURED WITH WAFERS HAVING PLURALITY OF CONTACTS ASSEMBLED THEREIN

BACKGROUND OF THE INVENTION

1. Field of the Invention

The present invention relates to a socket connector, and more particularly, to a socket connector having a frame with a plurality of wafers assembled therein. Each wafer includes a plurality of passageways each assembled with a contact terminal therein.

2. Description of Related Art

A typical socket connector is provided to interconnect two electronic devices, such as a printed circuit board and an IC (Integrated Circuit) package. Taiwanese Patent No. M340609 issued to Hon Hai on Sep. 11, 2008 discloses such a socket connector, which is generally mounted to a printed circuit and used for connecting and testing an IC package. The socket connector includes an upper retaining board and a lower retaining board stacked with each other. The upper and the lower retaining boards are respectively formed with a plurality of upper holes and a plurality of lower holes communicating with each other. A corresponding number of contacts are inserted into and retained in the upper holes and the lower holes, whereby top ends of the contact extend out of the upper board for contacting with the IC package, and the bottom ends of the contacts extend out of the lower board for contacting with the printed circuit board.

The socket connector described above employs two stacked board to retain the contacts. Consequently, the upper and the lower boards have to be respectively manufactured to have a plurality of holes, which thus make the process complicated and difficult. Moreover, if one hole in any board is broken or damaged to an extent of malfunctioned, the whole board has to be changed and replaced with another one, and the repairing and reworking cost is thus increased. In addition, the application flexibility of the retaining boards is relative low. For example, if the dimension of the socket connector is needed to be changed, both of upper and the low boards have to be changed.

In view of the above, an improved socket connector of low cost and fine manufacturability is needed.

SUMMARY OF THE INVENTION

Accordingly, an object of the present invention is to provide a socket connector having a plurality of wafers for retaining contacts.

According to one aspect of the present invention, there is provided a socket connector including a frame having a receiving cavity therein, a plurality of wafers aligned along a direction and received in the receiving cavity of the frame, and a plurality of contacts. The wafer is formed with a plurality of parallel slots located along at least one surface thereof and matched with corresponding slots of a neighboring wafer to constitute a plurality of receiving holes. The contacts are received in the receiving holes respectively. Each contact includes a top contacting section extending upwardly beyond an upper surface of the wafers and a bottom contacting section extending downwardly beyond a lower surface of the wafers.

Other objects, advantages and novel features of the invention will become more apparent from the following detailed description when taken in conjunction with the accompanying drawings, in which:

DETAILED DESCRIPTION OF THE INVENTION

Reference will now be made to the drawings to describe the present invention in detail.

Figure 1:
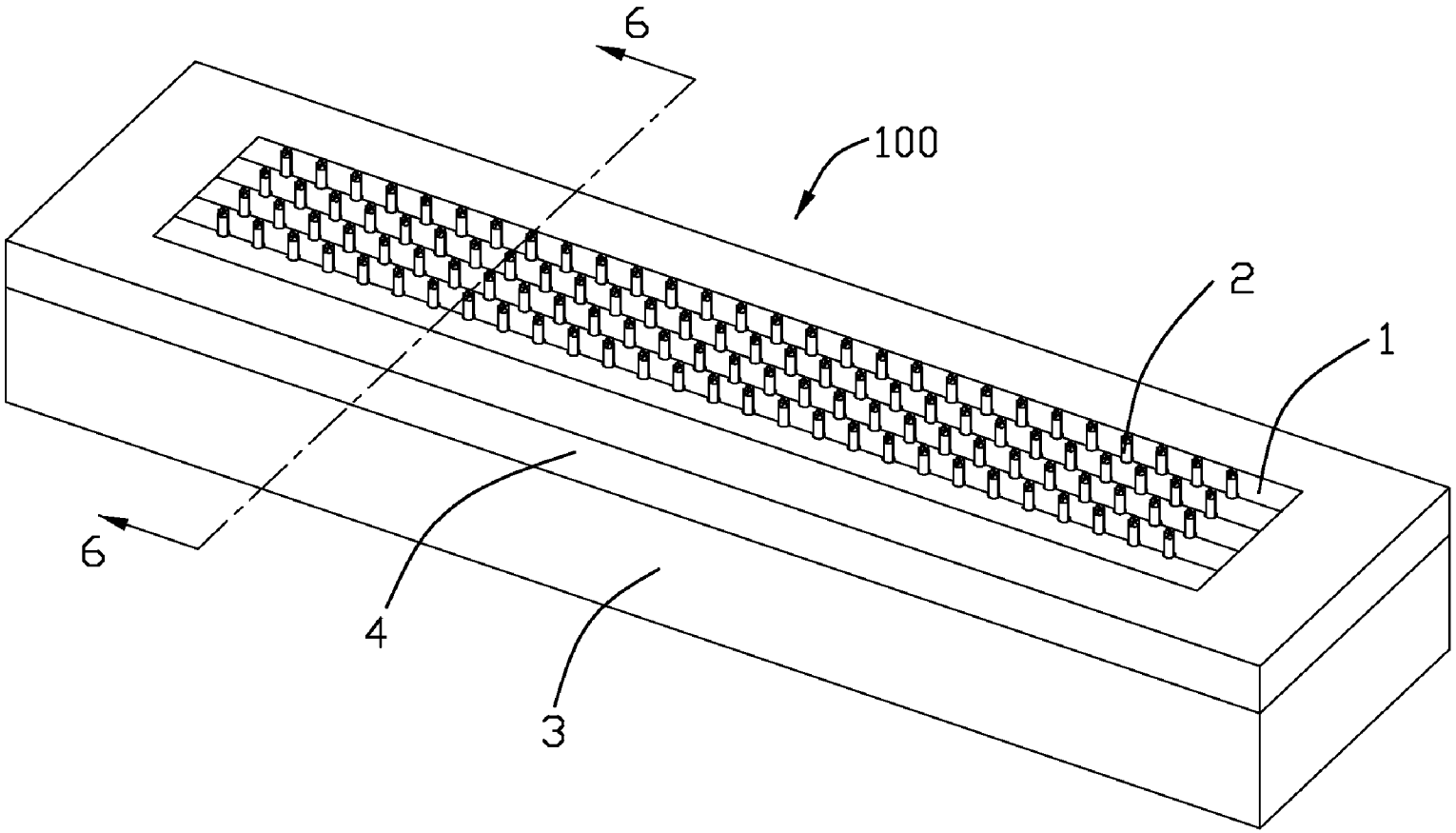
FIG. 1 is an assembled, perspective view of a socket connector in accordance with a preferred embodiment of the present invention.
Figure 2:
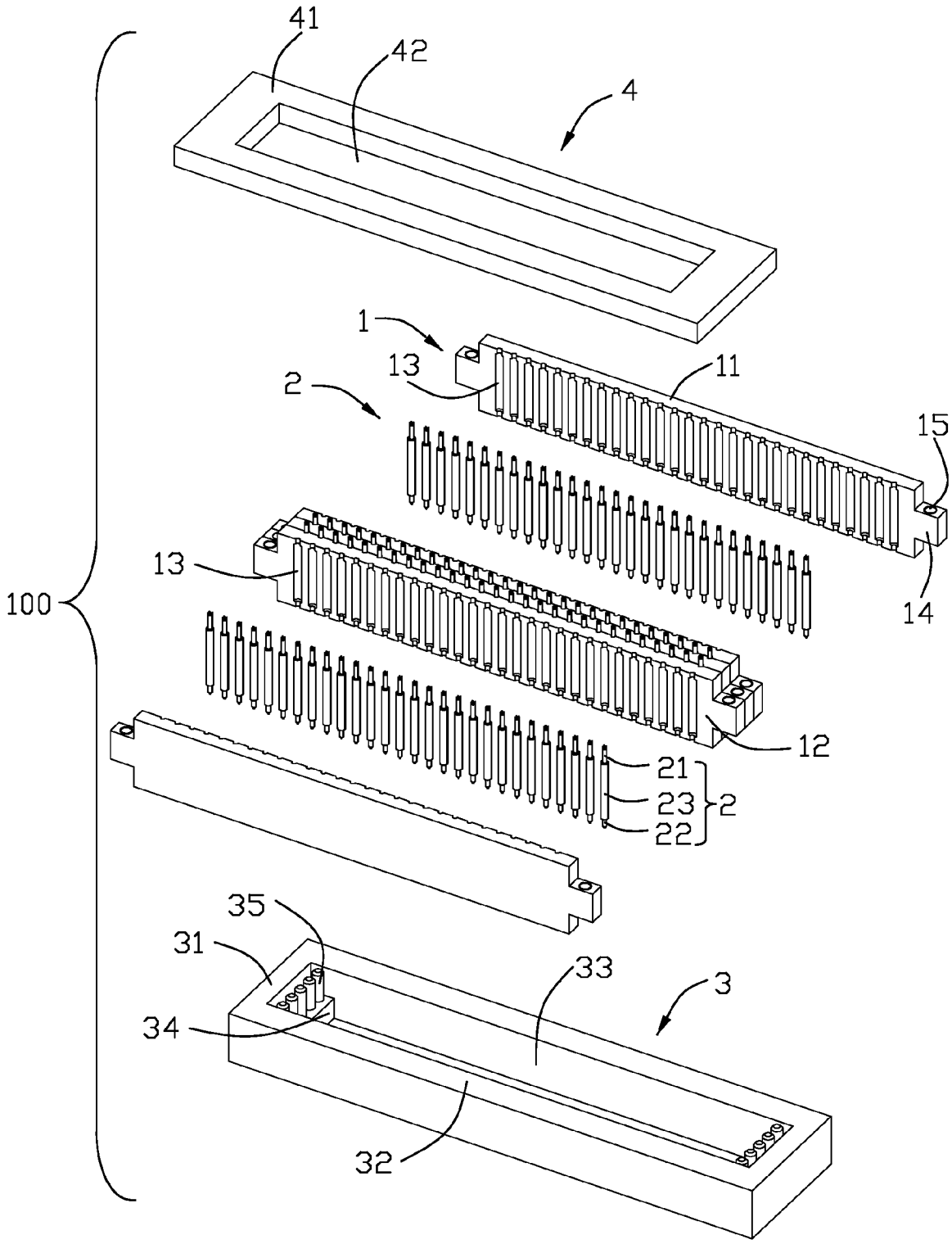
FIG. 2 is an exploded, perspective view of the socket connector shown in FIG. 1.

FIG. 1 and FIG. 2 illustrate a socket connector made in accordance with a preferred embodiment of the present invention. The socket connector 100 is generally mounted to a printed circuit board (not shown) for connecting an IC package (not shown). The socket connector 100 includes a frame 3 which has a receiving cavity 33 therein, a plurality of wafers 1 received and juxtaposed in receiving cavity 33, and plurality rows of contacts 2 received in the receiving cavity 33 and sandwiched between neighboring wafers 1. A cover 4 is further provided to be mounted upon the frame 3 for further positioning the wafers 1.

Figure 3:
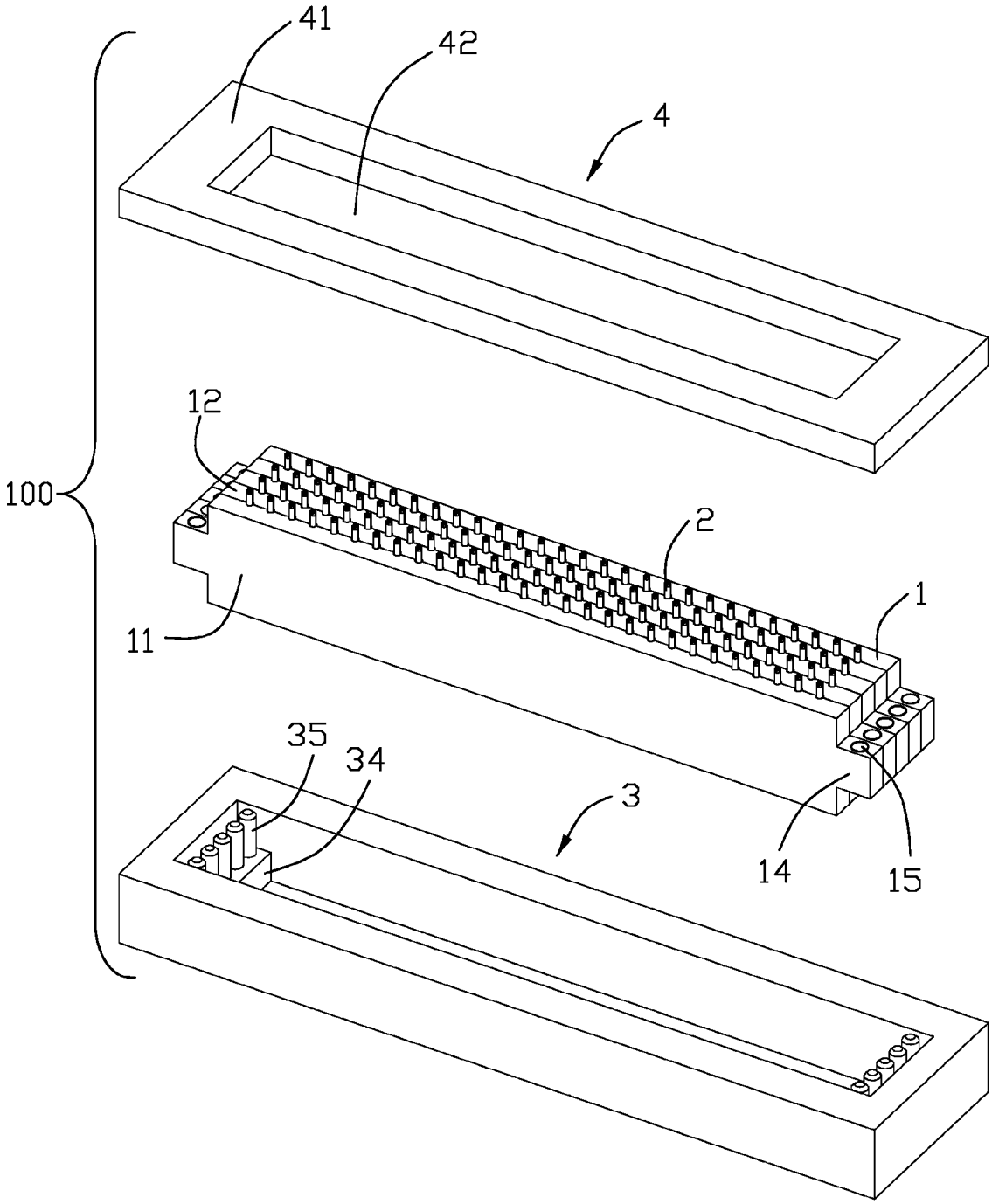
FIG. 3 is an exploded, perspective view of the socket connector shown in FIG. 1, showing a plurality of contacts retained in wafers.
Figure 4:
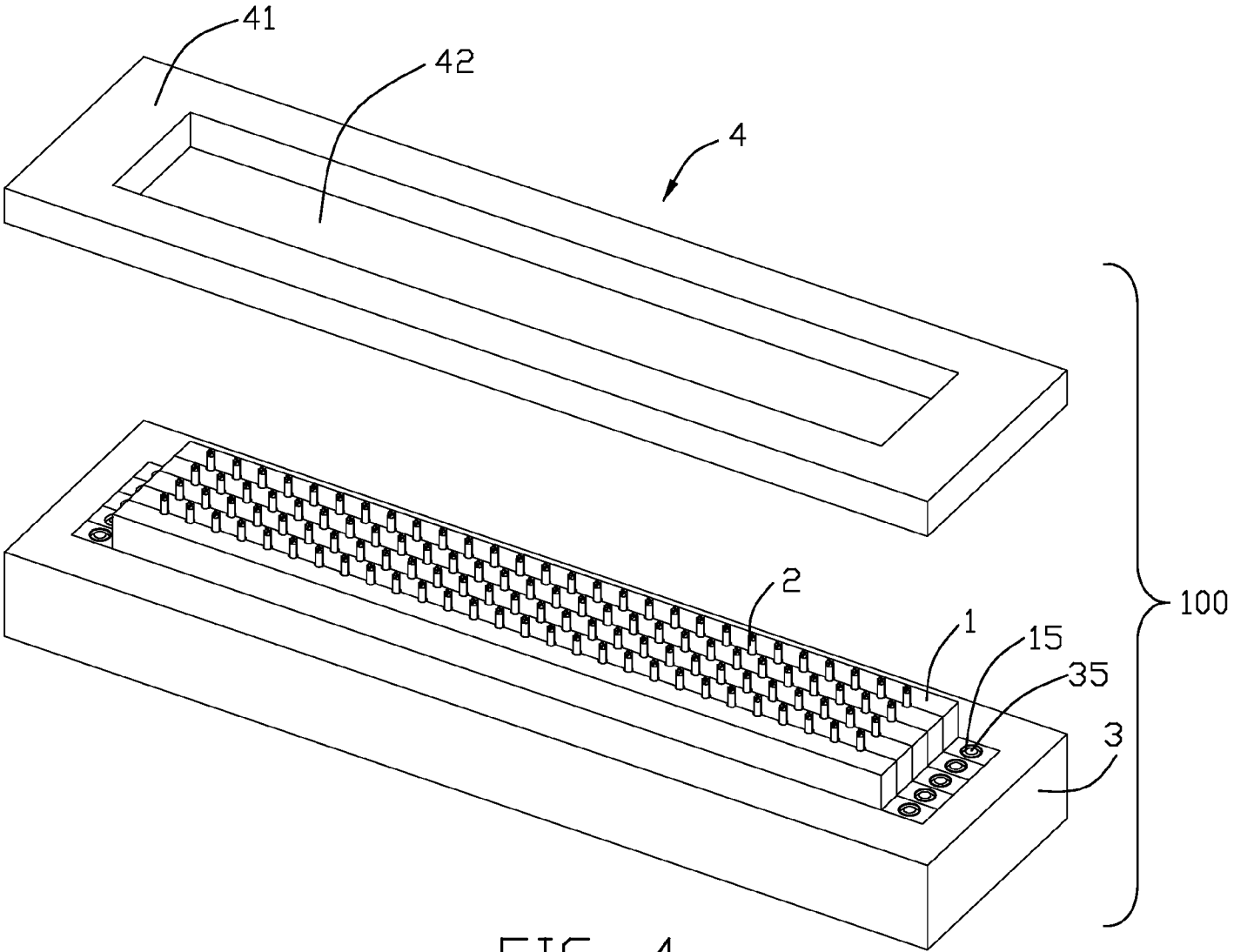
FIG. 4 is an exploded, perspective view of the socket connector shown in FIG. 1, showing a plurality of contacts and wafers are received in a frame.
Figure 5:
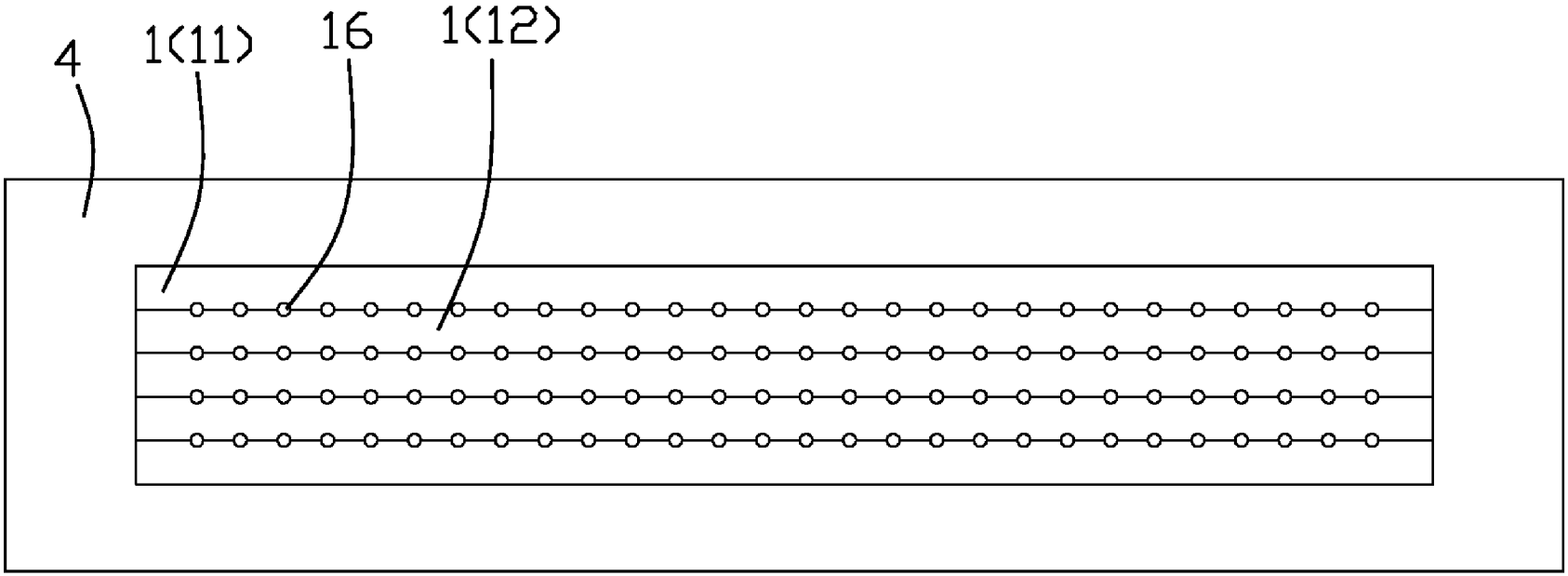
FIG. 5 is a top view of the assembly of the wafers and the frame of the socket connector shown in FIG. 1.
Figure 6:
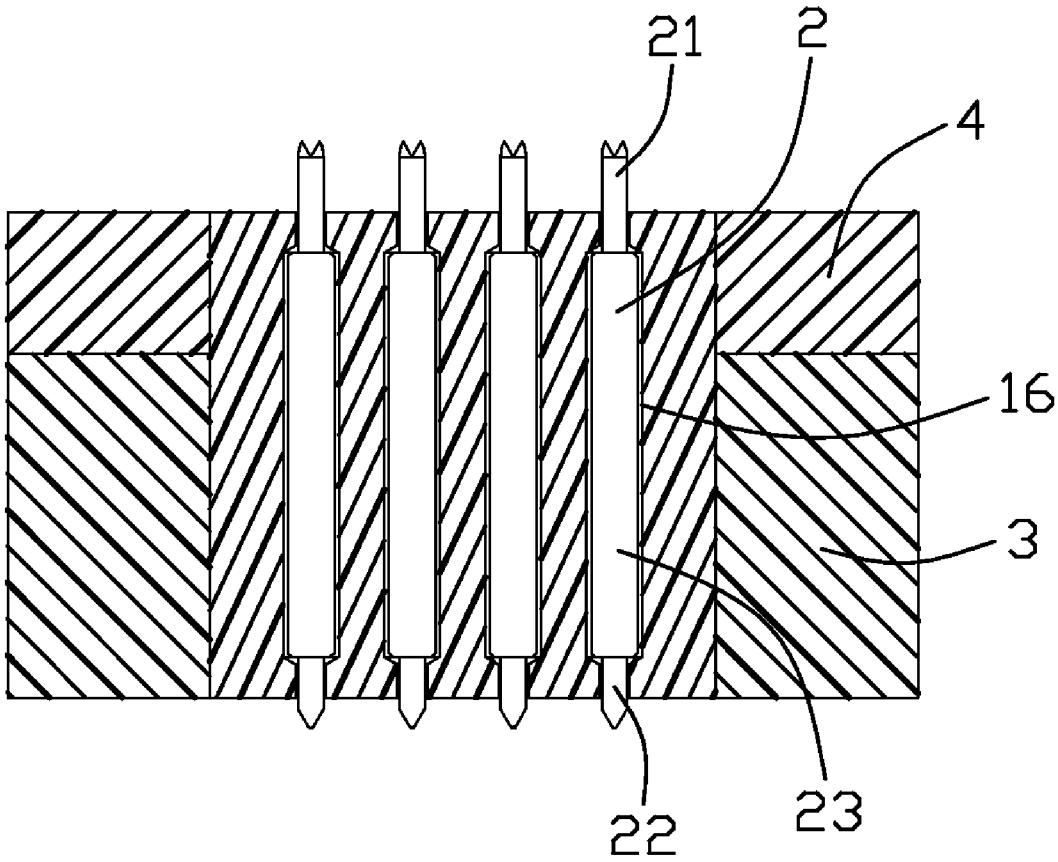
FIG. 6 is a sectional view of the socket connector shown in FIG. 1, taken from the line 6-6 in FIG. 1.

Referring to FIG. 2 to FIG. 4, the frame 3 is substantially rectangular in shape, having longitudinal sidewalls 31, lateral sidewalls 32 which together define a receiving cavity 33 formed therebetween for receiving the wafers 1 and the contacts 2. A pair of stepped portions 34 is integrally formed at two ends of the receiving cavity 33 and is respectively provided with a plurality of alignment posts 35 supported thereon. The wafers 1 are aligned and juxtaposed in the receiving cavity 33 along a longitudinal direction one by one. A pair of side-most wafers 11 located at opposite sides respectively have only one surface formed with a plurality of parallel slots 13. And, the left wafers 12 located between the side-most wafers 11 are formed with slot parallel 13 at both of two opposite surfaces thereof. Together referring to FIG. 5 and FIG. 6, the slot 13 of one wafer 11/12 is matched with a corresponding slot 13 of a neighboring wafer 11/12 to constitute a receiving hole 16 for receiving the contact 2. Consequently, the contacts 2 are sandwiched between neighboring wafers 1 so as to be retained therein.

The wafer 1 has a pair of ear portion 14 respectively having a alignment hole 15, which engages the alignment post 35 in the receiving cavity 33 of the frame 3 so that the wafers 1 are positioned and retained within the frame 3.

The contact 2 has a top contacting section 21 extending upwardly beyond an upper surface of the wafers 1 for contacting with the IC package, a bottom contacting section 22 extending downwardly beyond a lower surface of the wafers 1 for contacting with the printed circuit board, and a tube 23 enclosing the top contacting section 21 and the bottom contacting section 22 so that the top contacting section 21 and the bottom contacting section 22 are movable relative to each other via a spring member (not shown) in the tube 23.

A cover 4 of rectangular shape which defines sidewalls 41 and an opening 42 therein is mounted upon the frame 3. The wafer 1 has one portion protruding out of the receiving cavity 33 of the frame 3 and extending into the opening 42 of the cover 4.

In the case that the number of the contacts 2 is needed to be increased, only new wafers 12 of same structure are needed to be mounted to the receiving cavity 33 of the frame 3. Correspondingly, the dimensions of the frame 3 and the cover 4 are changed, respectively. Moreover, if one wafer is broken or malfunctioned, it can be readily pulled out and replaced with a new and functional one. Thus, the repairing cost of the present invention is relative low. Further, the manufacturability of forming slots 33 along surfaces of the wafer 1 is comparably better than that of forming through holes in a thick board.

While preferred embodiments in accordance with the present invention has been shown and described, equivalent modifications and changes known to persons skilled in the art according to the spirit of the present invention are considered within the scope of the present invention as defined in the appended claims.

What is claimed is:

1. A socket connector, comprising:

a frame having a receiving cavity therein;

a plurality of wafers aligned along a direction and received in the receiving cavity of the frame, the wafer being formed with a plurality of parallel slots located along at least one surface thereof and matched with corresponding slots of a neighboring wafer to constitute a plurality of receiving holes;

a plurality of contacts received in the receiving holes, respectively, each contact comprising a top contacting section extending upwardly beyond an upper surface of the wafers and a bottom contacting section extending downwardly beyond a lower surface of the wafers; and a cover mounted upon the frame and having an opening thereof, the wafer having one portion protruding out of the receiving cavity of the frame and extending into the opening.

2. The socket connector as claimed in claim 1, wherein the wafers comprises a pair of side-most wafers located at opposite sides and having only one surface formed with said slots.

3. The socket connector as claimed in claim 2, wherein the wafers comprises at least one wafer located between said side-most wafers and having two opposite surfaces formed with said slots.

4. The socket connector as claimed in claim 1, wherein the wafer has a pair of ear portions respectively having an alignment hole, the frame having a plurality of aligning posts in the cavity engaged the aligning hole.

5. The socket connector as claimed in claim 1, wherein the contact has a tube enclosing the top contacting section and the bottom contacting section which are movable relative to each other within the tube.

6. A socket connector, comprising:

a frame having a receiving cavity therein;

a plurality of wafers aligned one by one along a first direction; and a plurality of rows of contacts received in the receiving cavity of the frame, each row of contacts aligned in a second direction and sandwiched between two neighboring wafers; and a cover mounted upon the frame and having an opening thereof, the wafer having one portion protruding out of the receiving cavity of the frame and extending into the opening.

7. The socket connector as claimed in claim 6, wherein the wafer is formed with a plurality of parallel slots located along at least one surface thereof and matched with corresponding slots of the neighboring wafer to constitute a plurality of receiving holes for retaining the contacts.

8. The socket connector as claimed in claim 7, wherein the wafers comprising a pair of side-most wafers located at opposite sides and having only one surface formed with said slots.

9. The socket connector as claimed in claim 8, wherein the wafers comprising at least one wafer located between said side-most wafers and having two opposite surfaces formed with said slots.

10. The socket connector as claimed in claim 6, wherein the wafer has a pair of ear portion respectively having an alignment hole, the frame having a plurality of aligning post in the cavity engaged the aligning hole.

11. The socket connector as claimed in claim 6, wherein the contact has a top contacting section, a bottom contacting section, and a tube enclosing the top contacting section and the bottom contacting section so that the top contacting section and the bottom contacting section are movable relative to each other within the tube.

12. A socket connector comprising:

a plurality of wafers arranged with one another in a first direction in a parallel relation;

a constraining device holding the wafers in position so as to maintain said wafers in a parallel manner;

each of said wafers defining two opposite primary side faces and a plurality of slots, in at least one of said two primary side faces, initially open to an exterior along said first direction before said wafers are arranged together;

a plurality of contacts disposed into the corresponding slots from the exterior in a second direction opposite to said first direction; and a cover positioned upon the frame and covering said through holes and said alignment posts; wherein each of said contacts extends along a third direction perpendicular to both said first and second directions under condition that each of said contacts is equipped with a spring mechanism to urge two opposite end sections of each of said contacts outwardly away from each other in said third direction, and the corresponding slot defines two opposite step structures to confront said two opposite end sections, respectively, so as to resist forces derived from the spring mechanism.

13. The socket connector as claimed in claim 12, wherein the wafers are directly stacked with one another.

14. The socket connector as claimed in claim 13, wherein each of said wafers defines said slots in both primary side faces so that the slots in opposite side faces of the corresponding neighboring wafers cooperate with each other to sandwich correspond contacts therebetween in said first direction.

15. The socket connector as claimed in claim 12, wherein said constraining device includes a frame enclosing all said wafers in.

16. The socket connector as claimed in claim 12, wherein said constraining device for securing each of said wafers in position, includes a pair of alignment posts and a pair of through holes.

17. The socket connector as claimed in claim 16, wherein said pair of through holes are formed in the corresponding one of said wafers, and said pair of alignment are formed on a frame surrounding the wafers.

* * * * *